US008820433B2

(12) United States Patent
Kuehne et al.

(10) Patent No.: US 8,820,433 B2
(45) Date of Patent: Sep. 2, 2014

(54) AXIALLY COMPACT POWER TOOL

(75) Inventors: Brent A. Kuehne, Red Lion, PA (US); Ashok S. Baskar, Lutherville, MD (US); Michael F. Cannaliato, Bel Air, MD (US); William G. Harman, Jr., Glen Rock, PA (US); Trevor J. Koenig, Lancaster, PA (US)

(73) Assignee: Black & Decker Inc., Newark, DE (US)

( * ) Notice: Subject to any disclaimer, the term of this patent is extended or adjusted under 35 U.S.C. 154(b) by 400 days.

(21) Appl. No.: 13/221,355

(22) Filed: Aug. 30, 2011

(65) Prior Publication Data

US 2013/0048325 A1 Feb. 28, 2013

(51) Int. Cl.
*B21B 3/00* (2006.01)

(52) U.S. Cl.
USPC ..... 173/217; 173/216; 173/164

(58) Field of Classification Search
CPC ..... B25F 5/00; B25F 5/001; F16H 3/54; F16H 3/721
USPC ..... 173/216, 217, 104, 201, 213, 48, 74, 173/227; 74/520, 650; 403/298, 71, 78; 30/276; 83/703, 731; 192/58.4; 475/299, 307, 331; 408/124
See application file for complete search history.

(56) References Cited

U.S. PATENT DOCUMENTS

| | | | | |
|---|---|---|---|---|
| 2,406,389 | A | | 8/1946 | Lee |
| 3,095,757 | A | | 7/1963 | Thoma |
| 3,120,845 | A | | 2/1964 | Horner |
| 3,631,945 | A | | 1/1972 | Ollearo |
| 3,774,476 | A | * | 11/1973 | Sohnlein et al. ..... 475/299 |
| 3,794,124 | A | | 2/1974 | Biersack |
| 3,841,804 | A | | 10/1974 | Drutchas et al. |
| 4,005,347 | A | | 1/1977 | Erdman |
| 4,007,649 | A | | 2/1977 | Stirland |
| 4,169,990 | A | | 10/1979 | Lerdman |
| 4,280,359 | A | | 7/1981 | Schmid et al. |
| 4,327,302 | A | | 4/1982 | Hershberger |
| 4,331,432 | A | | 5/1982 | Blanchard |
| 4,390,826 | A | | 6/1983 | Erdman et al. |
| 4,434,546 | A | | 3/1984 | Hershberger |
| 4,437,325 | A | | 3/1984 | Hershberger |
| 4,449,079 | A | | 5/1984 | Erdman |
| 4,513,230 | A | | 4/1985 | Erdman |
| 4,529,044 | A | | 7/1985 | Klueber et al. |
| 4,532,459 | A | | 7/1985 | Erdman et al. |
| 4,556,827 | A | | 12/1985 | Erdman |

(Continued)

FOREIGN PATENT DOCUMENTS

| | | | | |
|---|---|---|---|---|
| EP | 2338647 A2 | | 6/2011 | |
| WO | WO 2011/062856 | * | 11/2010 | ..... F16D 35/02 |

*Primary Examiner* — Stephen F Gerrity
*Assistant Examiner* — Joy N Sanders
(74) *Attorney, Agent, or Firm* — Harness, Dickey & Pierce, P.L.C.

(57) ABSTRACT

A power tool that includes a housing, a trigger switch that is mounted to the housing, a tool output member and a motor and transmission assembly. The housing defines a handle. The motor and transmission assembly is coupled to the housing and is configured to drive the tool output member. The motor and transmission assembly include a motor, which is electrically coupled to the trigger switch, and a transmission having a transmission input member, which is drivingly coupled to the motor, and a transmission output member that is drivingly coupled to the tool output member. The motor and transmission are packaged in the housing in a manner that is extremely compact.

23 Claims, 4 Drawing Sheets

(56) References Cited

U.S. PATENT DOCUMENTS

| | | | | |
|---|---|---|---|---|
| 4,742,875 | A | 5/1988 | Bell | |
| 4,770,254 | A * | 9/1988 | Kominami | 173/109 |
| 4,806,717 | A | 2/1989 | Hershberger | |
| 4,930,583 | A * | 6/1990 | Fushiya et al. | 173/109 |
| 4,969,368 | A | 11/1990 | Sekine et al. | |
| 5,083,620 | A * | 1/1992 | Fushiya et al. | 173/217 |
| 5,090,488 | A * | 2/1992 | Cotton | 173/215 |
| 5,427,002 | A | 6/1995 | Edman | |
| RE35,372 | E | 11/1996 | Houben et al. | |
| 5,651,419 | A | 7/1997 | Holzer et al. | |
| 6,569,002 | B2 | 5/2003 | Smith et al. | |
| 7,609,011 | B2 | 10/2009 | Yatabe et al. | |
| 7,723,880 | B2 | 5/2010 | Dai | |
| 7,793,560 | B2 | 9/2010 | Bodine et al. | |
| 2005/0218185 | A1 * | 10/2005 | Kenney et al. | 227/133 |
| 2009/0003949 | A1 | 1/2009 | Mok et al. | |
| 2009/0003950 | A1 | 1/2009 | Mok et al. | |
| 2009/0033100 | A1 | 2/2009 | Dai | |
| 2010/0107423 | A1 | 5/2010 | Bodine et al. | |
| 2010/0108337 | A1 | 5/2010 | Norona et al. | |
| 2010/0113980 | A1 | 5/2010 | Herr et al. | |
| 2010/0114329 | A1 | 5/2010 | Casler et al. | |
| 2010/0174384 | A1 | 7/2010 | Herr et al. | |
| 2010/0174385 | A1 | 7/2010 | Casler et al. | |
| 2010/0179668 | A1 | 7/2010 | Herr et al. | |
| 2010/0276244 | A1 | 11/2010 | Bodine et al. | |
| 2010/0300226 | A1 | 12/2010 | Bodine et al. | |
| 2010/0319474 | A1 | 12/2010 | Bodine et al. | |
| 2012/0279820 | A1 * | 11/2012 | Hennessy et al. | 192/58.4 |

* cited by examiner

AXIALLY COMPACT POWER TOOL

FIELD

The present disclosure relates to an axially compact power tool.

BACKGROUND

This section provides background information related to the present disclosure which is not necessarily prior art.

Many power tools that are commercially available include a two-speed transmission with three or more transmission stages in an effort to provide the user with greater control over the output speed of these tools. The commercially available power tools typically employ a transmission that utilizes several planetary gear reductions that are aligned along a common rotational axis (see, e.g., U.S. Pat. No. 6,431,289), or a transmission that employs a spur gear arrangement (see, e.g., U.S. Pat. No. 4,418,766). We have found that it is difficult to compactly package such transmissions into a tool when the power tool is to be capable of producing a relatively high power (e.g., torque) output.

One solution is disclosed in U.S. Pat. No. 3,774,476 in which the transmission includes a spur gear reduction and planetary reduction. It would be desirable, however, to provide a power tool in which the motor and transmission are packaged in an even more compact manner.

SUMMARY

This section provides a general summary of the disclosure, and is not a comprehensive disclosure of its full scope or all of its features.

In one form the present teachings provide a power tool that includes a housing, a trigger switch mounted to the housing, an output spindle and a motor and transmission assembly. The housing defines a handle. The motor and transmission assembly is coupled to the housing and is configured to drive the output spindle. The motor and transmission assembly includes a motor, which is operated by the trigger switch, and a transmission that has a transmission input member, which is drivingly coupled to the rotor of the motor, and a transmission output member that is drivingly coupled to the output spindle such that the output spindle extends forwardly from the transmission output member. A rotational axis of the rotor is disposed parallel to but offset from a rotational axis of the output spindle and the stator and the output member are disposed forwardly of the transmission input member.

In another form the present teachings provide a power tool that includes a housing, a trigger switch that is mounted to the housing, a tool output member and a motor and transmission assembly. The housing defines a handle. The motor and transmission assembly is coupled to the housing and is configured to drive the tool output member. The motor and transmission assembly include a motor, which is electrically coupled to the trigger switch, and a transmission having a transmission input member, which is drivingly coupled to the motor, and a transmission output member that is drivingly coupled to the tool output member. The motor is arranged in an axial direction that is longitudinally parallel to and offset from a longitudinal axis of the tool output member. The transmission and the motor are packaged axially within the housing in a space that is axially shorter than ninety percent (90%) of a sum of an axial length of the motor and an axial length of the transmission.

In still another form, the present teachings provide a power tool that includes a housing, a trigger switch that is mounted to the housing, a tool output member and a motor and transmission assembly. The housing defines a handle. The motor and transmission assembly is coupled to the housing and is configured to drive the tool output member. The motor and transmission assembly include a motor, which is electrically coupled to the trigger switch, and a transmission having a transmission input member, which is drivingly coupled to the motor, and a transmission output member that is drivingly coupled to the tool output member. The center of gravity of the transmission and the center of gravity of the motor are disposed both vertically above the trigger switch and between fore and aft ends of the handle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
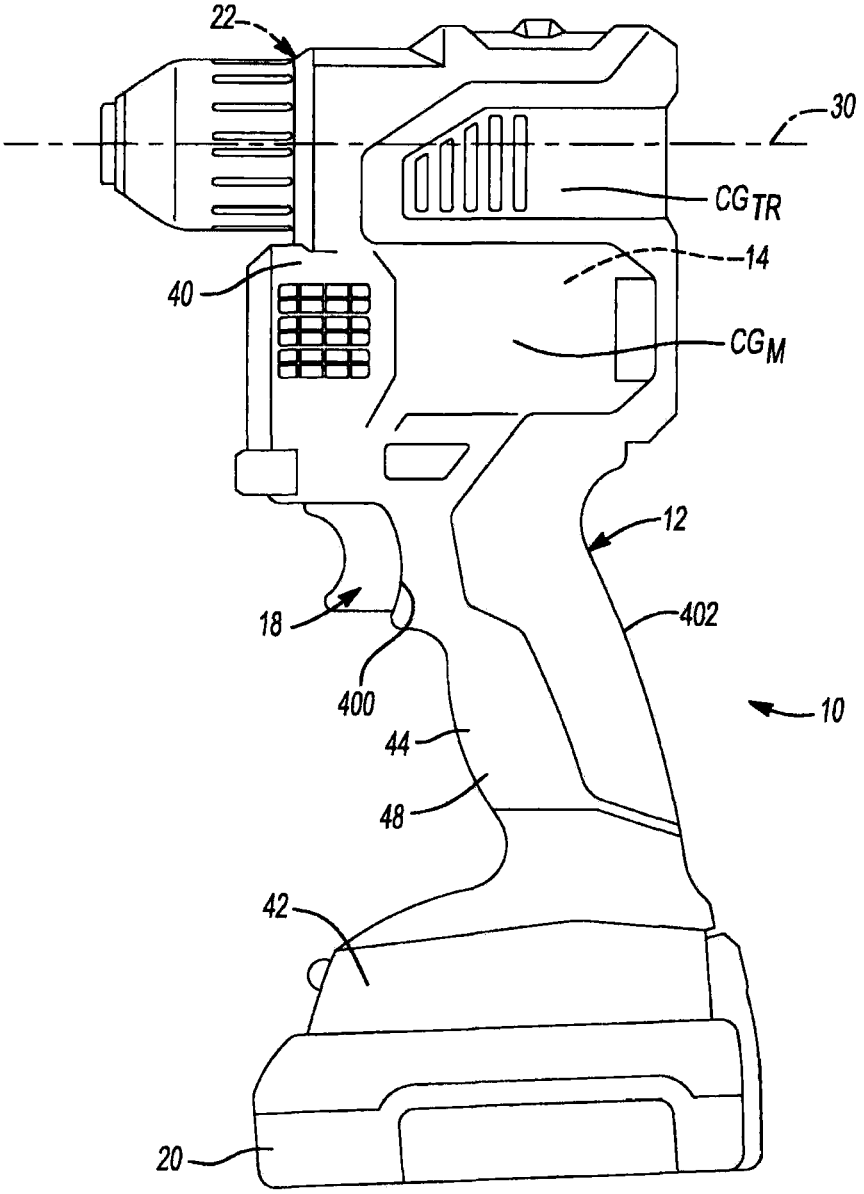
FIG. 1 is a side elevation view of an exemplary power tool constructed in accordance with the teachings of the present disclosure.
Figure 2:
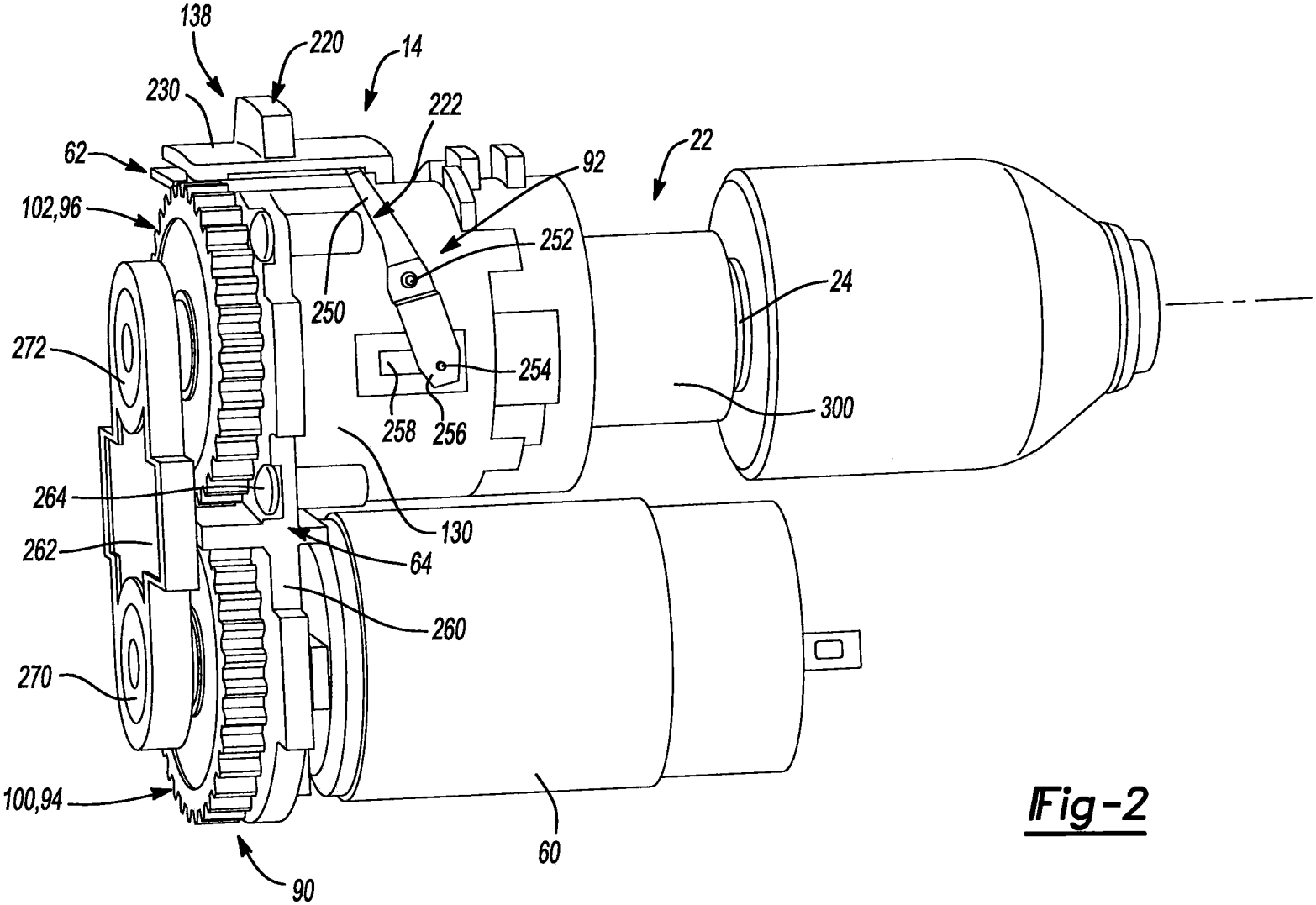
FIG. 2 is a perspective view of a portion of the power tool of FIG. 1 illustrating the motor and transmission assembly and the output spindle assembly in more detail.

With reference to FIGS. 1 and 2, a power tool constructed in accordance with the teachings of the present disclosure is generally indicated by reference numeral 10. The power tool 10 can include a housing 12, a motor and transmission assembly 14, a trigger switch 18, a battery pack 20 and an output spindle assembly 22 having an output member or output spindle 24. The power tool 10 can be any type of power tool, but in the particular example provided, the power tool 10 is a drill/driver and has the output member 24 is a spindle that is rotatable about a rotary axis 30. It will be appreciated, however, that the output member 24 of the power tool 10 could additionally or alternatively be reciprocated by the motor and transmission assembly 14. It will also be appreciated that while the particular power tool 10 illustrated and described herein is a battery-powered "cordless" tool, the teachings of the present disclosure have application to corded (i.e., AC powered) electric tools, as well as tools having motors that are powered by other means, including pneumatics or hydraulics.

The housing 12 can be formed in any desired manner and can comprise a housing body 40, a battery mount 42 and a handle 44. In the particular example provided, the housing 12 comprises a pair of clam shell housing members 48 that cooperate to define the housing body 40 and the handle 44. The housing body 40 can be coupled to the handle 44 on a side opposite the battery mount 42 and can define a cavity into which the motor and transmission assembly 14 can be received. The handle 44 is depicted in the particular example provided as presenting the power tool 10 with a generally T-shaped configuration and as such, would be understood by those of ordinary skill in the art as having a "T-handle" configuration. It will be understood that the teachings of the present disclosure are not limited to power tools having a T-handle configuration and have application to power tools with other handle types, including pistol-grip type handles (i.e., a straight handle that extends from a rear end of the housing body, rather than an angled handle that extends from a point between the fore and aft ends of the housing body).

The trigger switch 18 and the battery pack 20 can be configured in a conventional manner and as such, need not be described in significant detail herein. Briefly, the trigger switch 18 can be any type of switch that can be electrically coupled to the battery pack 20 and the motor and transmission assembly 14, such as a variable speed switch that includes a variable speed controller as is commonly used in the art. The trigger switch 18 can be mounted to the handle 44 in a conventional manner so as to be accessible by a user's index finger when the user's hand is grasping the handle 44. The battery pack 20 can be removably coupled to the battery mount 42 in any desired manner.

The motor and transmission assembly 14 can be received in the housing body 40 and can comprise a motor 60, a transmission 62 and a mount structure 64.

Figure 3:
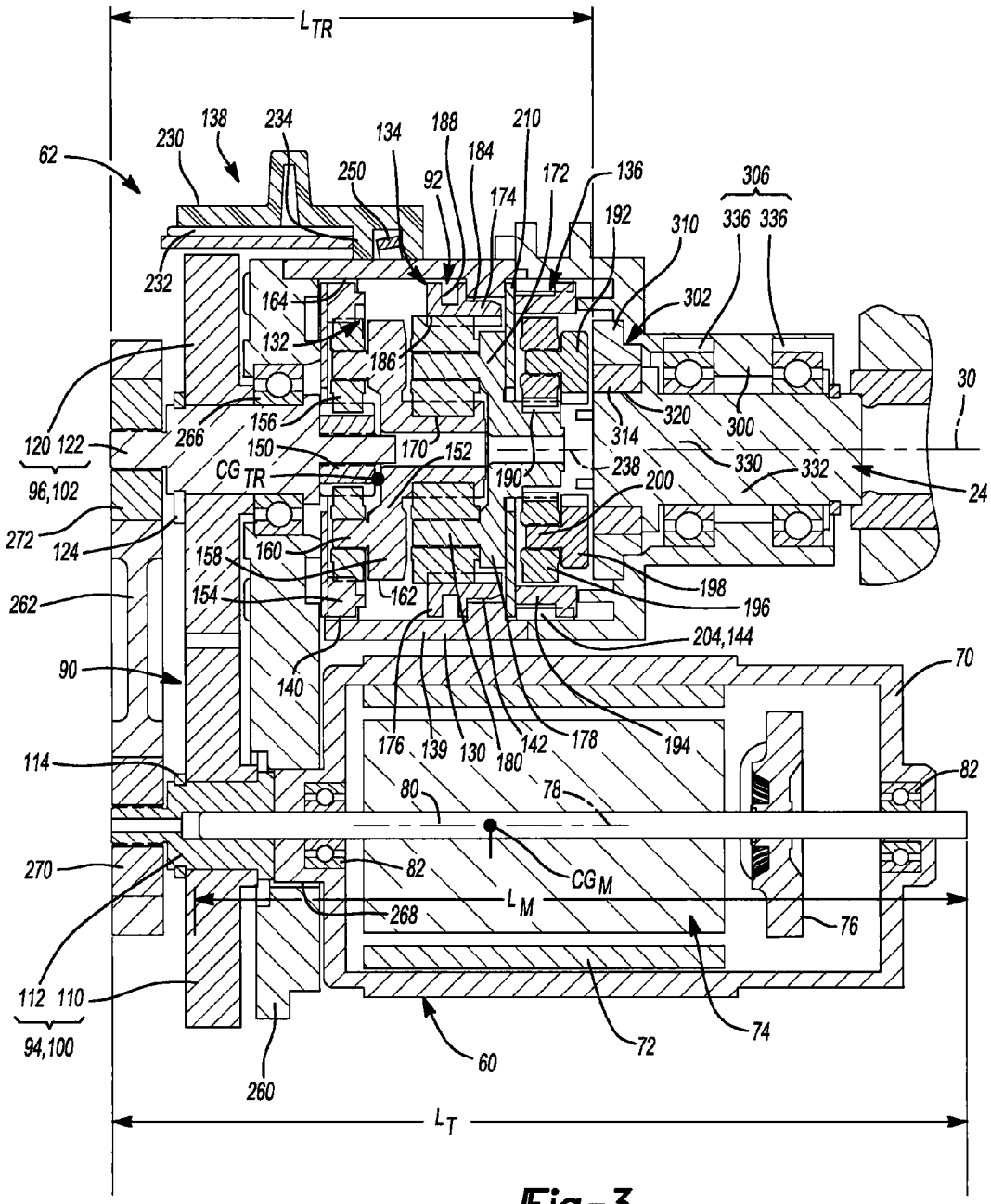
FIG. 3 is a longitudinal section view of a portion of the power tool of FIG. 1 illustrating the motor and transmission assembly and the output spindle assembly in more detail.

With reference to FIGS. 2 and 3, the motor 60 can be conventional in its construction and can comprise a motor case 70, a stator 72, a rotor 74 and a cooling fan 76. The stator 72 can be fixedly and non-rotatably coupled to the motor case 70. The rotor 74 can be disposed within the stator 72 for rotation about a rotor axis 78 and can include a rotor shaft 80 that can be supported relative to the motor case 70 via a set of bearings 82. The rotor axis 78 can be parallel to but offset from (i.e., non-coincident with) the rotational axis 30 of the output member 24. The cooling fan 76 can be mounted on the rotor shaft 80 and can be configured to generate a flow of air that passes through the motor 60 during operation of the motor 60.

The transmission 62 can be any type of transmission and can have a single-stage or multi-stage configuration as well as a single-speed or multi-speed configuration. In the particular example provided, the transmission 62 is a multi-stage, multi-speed transmission having a first transmission portion 90 and a second transmission portion 92.

The first transmission portion 90 can include a transmission input member 94, which can be coupled to the rotor shaft 80 for rotation therewith, and an intermediate output member 96 that outputs rotary power to the second transmission portion 92. In the example provided, the transmission input member 94 comprises a first gear 100 and the intermediate output member 96 comprises a second gear 102. The first gear 100 can have a first gear portion 110, which can have teeth formed about its circumference, and a first shaft portion 112 that can be mounted to and fixedly coupled with the rotor shaft 80. In the particular example provided, the first gear portion 110 and the first shaft portion 112 are discrete components that are coupled to one another (via a press-fit and a retaining ring 114), but it will be appreciated that the first gear portion 110 and the first shaft portion 112 could be integrally and unitarily formed. The second gear 102 can have a second gear portion 120, which can have teeth formed about its circumference that are meshingly engaged with the teeth of the first gear portion 110, and a second shaft portion 122. In the particular example provided, the second gear portion 120 and the second shaft portion 122 are discrete components that are coupled to one another (via a press-fit and a retaining ring 124), but it will be appreciated that the second gear portion 120 and the second shaft portion 122 could be integrally and unitarily formed. While the first and second gears 100 and 102 are depicted as having spur gears that are meshingly engaged with one another, it will be appreciated that other gear configurations, such as helical gearing, may be employed and/or that other gears could be employed to transmit rotary power between the first and second gears 100 and 102.

The second transmission portion 92 can comprise a gear case 130, a first planetary reduction 132, a second planetary reduction 134, a third planetary reduction 136 and a speed selector mechanism 138. The gear case 130 can be formed in one or more sections and can include a generally hollow cylindrical case portion 139 that can define first, second and third radial lugs 140, 142 and 144, respectively.

With specific reference to FIG. 3, the first planetary reduction 132 can include a first sun gear 150, which can be coupled to the second shaft portion 122 for rotation therewith, a first planet carrier 152, a first ring gear 154, and a plurality of first planet gears 156. The first planet carrier 152 can include a first carrier body 158 and a plurality of pins 160, each of which being fixedly coupled to the first carrier body 158 and journally supporting an associated one of the first planet gears 156. Teeth 162 can be formed about the circumference of the first carrier body 158. The first ring gear 154 can include a plurality of lugs 164 that can be matingly engaged to the first radial lugs 140 to thereby non-rotatably couple the first ring gear 154 to the gear case 130. The first planet gears 156 can be meshingly engaged to the teeth of the first ring gear 154 and the teeth of the first sun gear 150.

The second planetary reduction 134 can include a second sun gear 170, which can be coupled to the first carrier body 158 for rotation therewith, a second planet carrier 172, a second ring gear 174, and a plurality of second planet gears 176. The second planet carrier 172 can include a second carrier body 178 and a plurality of pins 180, each of which being fixedly coupled to the second carrier body 178 and journally supporting an associated one of the second planet gears 176. The second ring gear 174 can be slidably received in the gear case 130 between a first position, in which lugs 184 on the second ring gear 174 are meshingly engaged to the second radial lugs 142 in the gear case 130 to thereby non-rotatably couple the second ring gear 174 to the gear case 130, and a second position in which the lugs 184 on the second ring gear 174 are disengaged from the second radial lugs 142 and the internal teeth 186 of the second ring gear 174 are meshingly engaged to the teeth 162 formed about the circumference of the first carrier body 158. A circumferentially extending groove 188 can be formed about the circumference of the second ring gear 174 rearwardly of the lugs 184. The second planet gears 176 can be meshingly engaged to the teeth of the second ring gear 174 and the teeth of the second sun gear 170.

The third planetary reduction 136 can include a third sun gear 190, which can be coupled to the second carrier body 178 for rotation therewith, a third planet carrier 192, a third ring gear 194, and a plurality of third planet gears 196. The third planet carrier 192 can include a third carrier body 198 and a plurality of pins 200, each of which being fixedly coupled to the third carrier body 198 and journally supporting an associated one of the third planet gears 196. In the particular example provided, the third planet carrier 192 is the output member of the transmission 62. The third ring gear 194 can include a plurality of lugs 204 that can be matingly engaged to the third radial lugs 144 to thereby non-rotatably couple the third ring gear 194 to the gear case 130. The third planet gears 196 can be meshingly engaged to the teeth of the third ring gear 194 and the teeth of the third sun gear 190.

If desired, one or more thrust washers 210 can be disposed between one or more adjacent pairs of the several planetary reductions to limit axial movement of various components of the transmission 62 and/or of the output spindle assembly 22.

With renewed reference to FIGS. 2 and 3, the speed selector mechanism 138 can be any type of mechanism for selectively positioning the second ring gear 174 in the first and second positions. In the particular example provided, the speed selector mechanism 138 comprises a switch assembly 220 and an actuator 222. The switch assembly 220 can comprise a switch member 230, a detent spring 232 and a shift fork 234. The switch member 230 can be mounted to the housing 12 for translation parallel to a longitudinal axis 238 of the second transmission portion 92 between a first switch position and a second switch position. The detent spring 232 can be coupled to the switch member 230 for movement therewith and can resiliently engage conventional detent slots (not specifically shown) formed in the housing 12 (FIG. 1) when the switch member 230 is in the first and second switch positions to thereby resist movement of the switch member 230 relative to the housing 12 (FIG. 1). The shift fork 234 can be coupled to the switch member 230 for movement therewith and can engage the actuator 222 to cause movement of the actuator 222 in response to movement of the switch member 230.

The actuator 222 can comprise a yoke 250, a pair of pivot pins 252 (only one of which is shown) and a pair of actuator pins 254 (only one of which is shown). The yoke 250 can extend about a portion of the circumference of the gear case 130 and can be received into the shift fork 234. The pivot pins 252 can pivotally couple the yoke 250 to opposite lateral sides of the gear case 130. The actuator pins 254 can be fixedly coupled to the distal ends 256 of the yoke 250 and can extend through windows 258 (only one of which is shown) formed through the gear case 130 and into the circumferentially extending groove 188 in the second ring gear 174. It will be appreciated that translation of the switch member 230 can cause corresponding pivoting of the yoke 250 about the pivot pins 252 and a corresponding pivoting movement of the actuator pins 254, which is employed to translate the second ring gear 174.

The mount structure 64 can include a first mount 260 and a second mount 262 that can be fixedly coupled to one another. In the example provided, the first mount 260 is a plate-like structure to that is coupled to the motor 60 and the gear case 130 via a plurality of threaded fasteners 264. A bearing 266 can be received in the first mount 260 to accurately locate as well as rotatably support the second shaft portion 122, while portion of the motor case 70 can be received in a bore 268 in the first mount 260 to accurately locate the motor 60. If desired, the mount structure 64 can also include a second mount 262 having two bearings 270 and 272 into which respective ends of the first and second shaft portions 112 and 122, respectively, can be received. It will be appreciated that the second mount 262 can help resist deflection of the first and second shaft portions 112 and 122 when relatively large torsional loads are transmitted between the first and second gears 100 and 102.

The output spindle assembly 22 can comprise a spindle housing 300, a spindle lock 302, the output member 24 and a set of bearings 306. The spindle housing 300 can be integrally formed with a portion of the gear case 130. The general construction of spindle locks are well known in the art and as such, a detailed discussion of a spindle lock 302 need not be provided herein. In the particular example provided, the spindle lock 302 comprises a spindle lock bushing 310, which is nonrotatably coupled to the spindle housing 300, a plurality of drive members (not specifically shown), which are coupled to and extend forwardly from the third carrier body 198 and are received concentrically within the spindle lock bushing 310, an anvil 314, which is mounted concentrically within the drive members, and a plurality of cylindrical pins (not specifically shown). The anvil 314 has a plurality of flat side edges (not specifically shown) and a non-circular aperture 320. Each of the cylindrical pins can be received circumferentially between an associated pair of the drive members and radially between the spindle lock bushing 310 and an associated one of the flat side edges. The output member 24 can be a shaft-like structure having an engagement end 330, which can be received into the aperture 320 in the anvil 314, and a shaft segment 332 that can extend through the spindle housing 300. The set of bearings 306 can be mounted in the spindle housing 300 and can support the output member 24 for rotation about the rotational axis 30. In the particular example provided, the set of bearings 306 comprises a pair of ball bearings 336 that are mounted on the shaft segment 332, but it will be appreciated that other bearing types, e.g., one or more plain bearings, could be used in the alternative and/or that the location of individual bearing elements may be different from that which is depicted here.

The motor and transmission assembly 14 can be configured to shorten the axial length of the power tool 10 as compared to traditional designs. In one aspect of the present disclosure, the transmission output member (i.e., the third planet carrier 192 in the example provided) is drivingly coupled to the output member 24 such that the output member 24 extends forwardly from the transmission output member, a rotational axis 78 of the rotor 74 is disposed parallel to but offset from the rotational axis 30 of the output member 24 and both the stator 72 and the output member 24 are disposed forwardly of the transmission input member 94.

In another aspect of the present disclosure, the motor 60 is arranged in an axial direction that is longitudinally parallel to a longitudinal axis 30 of the output member 24, and the transmission 62 and the motor 60 are packaged axially within the housing 12 in a space $L_T$ that is axially shorter than ninety percent (90%) of a sum of an overall axial length $L_M$ of the motor 60 and an overall axial length $L_{TR}$ of the transmission 62. In some cases, the axial space $L_T$ in the housing 12 into which the transmission 62 and the motor 60 are packaged is shorter than eighty seven percent (87%) of the sum of the overall axial length $L_M$ of the motor 60 and the overall axial length $L_{TR}$ of the transmission 62. For example, the axial space $L_T$ in the housing into which the transmission 62 and the motor 60 are packaged can be about eighty four percent (84%) of the sum of the overall axial length $L_M$ of the motor 60 and the overall axial length $L_{TR}$ of the transmission 62. The packaging of the motor 60 and the transmission 62 in this manner permits the set of bearings 306 that supports the output member 24 to be disposed between the axially opposite ends of the motor and transmission assembly 14. In some cases, an end of the motor 60 that is opposite the transmission input member 94 can extend forwardly of the set of bearings 306. Additionally or alternatively, the cooling fan 76 can be disposed forwardly of the transmission 62.

In another aspect of the present disclosure, a center of gravity $CG_{TR}$ of the transmission 62 and a center of gravity $CG_M$ of the motor 60 are disposed both vertically above the trigger switch 18 and between fore and aft ends 400 and 402 of the handle 44 as is shown in FIG. 1.

Figure 4:
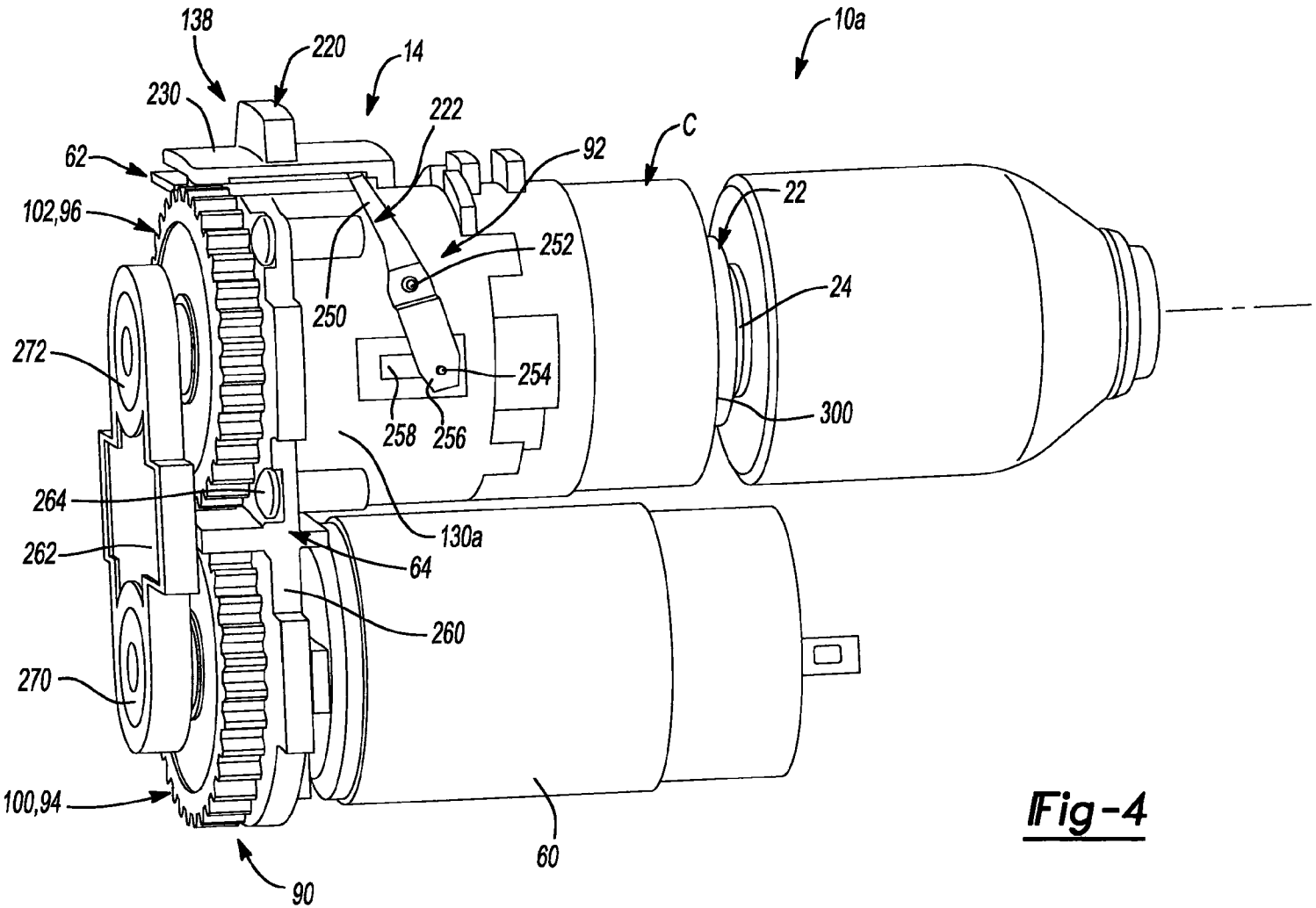
FIG. 4 is a perspective view of a portion of another power tool constructed in accordance with the teachings of the present disclosure.

A portion of another power tool constructed in accordance with the teachings of the present disclosure is generally indicated by reference numeral 10*a* in FIG. 4. The power tool 10*a* differs from the power tool 10 (FIGS. 1-3) only in that the third ring gear (not specifically shown) is rotatably received in the gear case 130*a* and a torque clutch C is integrated into the tool. The torque clutch C is only schematically shown in FIG. 4, but is constructed in a conventional manner so as to include a spring (not shown) that generates a clutch force that is transmitted through pins (not shown) that extend through the gear case 130*a* and engage a clutch surface (not shown) formed on the third sun gear. The torque clutch C can include an adjustment mechanism that can be employed to permit a user of the power tool 10*a* to manually adjust the clutch force that is generated by the clutch spring. In operation, the power tool 10*a* can output rotary power until the torque reaction on the third ring gear is sufficient to cause the third ring gear to rotate so that the pins are urged against the bias of the clutch spring such that the clutch surface rides over the pins. Those of skill in the art will appreciate that rotation of the third ring gear will substantially inhibit the transmission of torque between the transmission assembly and the output member 24.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A power tool comprising: a housing defining a handle; a trigger switch mounted to the housing; an output spindle; and a motor and transmission assembly removably coupled to the housing and configured to drive the output spindle, the motor and transmission assembly comprising a first mount, a second mount, a motor, and a transmission, the first mount being removably coupled to the housing and having a first aperture and a second aperture, the second mount being removably coupled to the housing, and the motor being operated by the trigger switch and having a stator and a rotor, the stator being fixedly mounted to the first mount, the rotor having a rotor spindle being received through the first aperture, the transmission being mounted to the first mount and having a transmission input member, which is drivingly coupled to the rotor spindle, an intermediate spindle, which is received through the second aperture and supported by the second mount on a side of the intermediate spindle opposite the first mount, and a transmission output member that is drivingly coupled to the output spindle such that the output spindle extends forwardly from the transmission output member; wherein a rotational axis of the rotor is disposed parallel to but offset from a rotational axis of the output spindle and wherein the stator and the output member are disposed forwardly of the transmission input member; and wherein when the rotational axis of the output spindle is positioned in a horizontal orientation such that the rotational axis of the output spindle is vertically above the rotational axis of the rotor, the trigger switch is located vertically below the rotor.

2. The power tool of claim 1, wherein the transmission is a multi-stage transmission.

3. The power tool of claim 2, wherein at least one of the stages of the transmission has a planetary configuration.

4. The power tool of claim 2, wherein the transmission is a multi-speed transmission.

5. The power tool of claim 4, wherein at least one of the stages of the transmission has a planetary configuration.

6. The power tool of claim 1, wherein the transmission input member is a first gear that is coupled to the rotor spindle for rotation therewith, and wherein the first gear has teeth formed about its circumference that meshingly engage a second gear that is mounted for rotation about the rotational axis of the output spindle.

7. The power tool of claim 6, wherein the second gear is mounted on the intermediate spindle, wherein the intermediate spindle is supported for rotation on the first mount.

8. The power tool of claim 7, wherein the second gear is disposed between the first and second mounts.

9. The power tool of claim 8, wherein the second mount comprises a bushing that supports the rotor spindle on a side of the first gear opposite the first mount.

10. The power tool of claim 1, further comprising a battery pack mounted to the housing, wherein the trigger switch electrically couples the battery pack to the motor.

11. The power tool of claim 1, further comprising a torque clutch for limiting torque transmission between the motor and transmission assembly and the output spindle.

12. A power tool comprising: a housing defining a handle; a trigger switch mounted to the housing and extending from a front side of the handle; a tool output member; and a motor and transmission assembly removably coupled to the housing and configured to drive the tool output member, the motor and transmission assembly comprising a first mount, a second mount, a motor, and a transmission, the first and second mounts being removable coupled to the housing, the motor having a motor body fixedly mounted to a first side of the first mount, the motor being electrically coupled to the trigger switch, the transmission having a transmission case, which is fixedly mounted to the first side of the first mount, a transmission input member, which is supported for rotation by the second mount and drivingly coupled to the motor between the first and second mounts, and a transmission output member that is drivingly coupled to the tool output member; wherein the motor is arranged in an axial direction that is longitudinally parallel to a longitudinal axis of the tool output member and wherein the transmission and the motor are packaged axially within the housing in a space that is axially shorter than ninety percent (90%) of a sum of an overall axial length of the motor and an overall axial length of the transmission; and wherein when the longitudinal axis of the tool output member is disposed horizontally such that the motor is disposed below the tool output member, the front side of the handle is disposed forwardly of the center of gravity of the transmission.

13. The power tool of claim 12, wherein the axial space in the housing into which the transmission and the motor are packaged is shorter than eighty seven percent (87%) of the sum of the overall axial length of the motor and the overall axial length of the transmission.

14. The power tool of claim 13, wherein the axial space in the housing into which the transmission and the motor are packaged is about eighty four percent (84%) of the sum of the overall axial length of the motor and the overall axial length of the transmission.

15. The power tool of claim 12, wherein the tool output member is supported by a bearing set and wherein the bearing set is disposed between axially opposite ends of the motor and transmission assembly.

16. The power tool of claim 15, wherein an end of the motor opposite the transmission input member extends forwardly of the bearing set.

17. The power tool of claim 16, wherein the motor comprises a rotor and a cooling fan that is coupled to the rotor for rotation therewith, and wherein the cooling fan is disposed forwardly of the transmission.

18. The power tool of claim 12, wherein the transmission is a multi-stage, multi-speed transmission.

19. The power tool of claim 12, further comprising a torque clutch for limiting torque transmission between the motor and transmission assembly and the tool output member.

20. A power tool comprising: a housing defining a handle; a trigger switch mounted to the housing and extending from a front side of the handle; a tool output member disposed vertically above the trigger switch and extending from the housing in a forward direction; and a motor and transmission assembly removably coupled to the housing and configured to drive the tool output member, the motor and transmission assembly comprising a first mount, a second mount, a motor, and a transmission, the first and second mounts being removably coupled to the housing, the motor having a motor body fixedly mounted to a first side of the first mount, the motor being electrically coupled to the trigger switch, the transmission having a transmission case, which is fixedly mounted to the first side of the first mount, a transmission input member which is received through the first mount, supported for rotation by the second mount, and drivingly coupled to the motor between the first and second mounts, and a transmission output member that is drivingly coupled to the tool output member; wherein a center of gravity of the transmission and a center of gravity of the motor are disposed both vertically above the trigger switch and between the front side and a rear side of the handle.

21. The power tool of claim 20, wherein the transmission is a multi-stage, multi-speed transmission.

22. The power tool of claim 21, further comprising a battery pack mounted to the housing, wherein the trigger switch electrically couples the battery pack to the motor.

23. The power tool of claim 22, further comprising a torque clutch for limiting torque transmission between the motor and transmission assembly and the tool output member.

* * * * *

UNITED STATES PATENT AND TRADEMARK OFFICE

CERTIFICATE OF CORRECTION

PATENT NO. : 8,820,433 B2
APPLICATION NO. : 13/221355
DATED : September 2, 2014
INVENTOR(S) : Brent A. Kuehne et al.

It is certified that error appears in the above-identified patent and that said Letters Patent is hereby corrected as shown below:

In the Claims

Column 8,

Line 31 (Claim 12), “removable” should be -- removably --.

Column 10,

Line 3 (Claim 20), after “member” insert -- , --.

Signed and Sealed this
Eighteenth Day of November, 2014

Michelle K. Lee

Michelle K. Lee
*Deputy Director of the United States Patent and Trademark Office*